US008845341B2

(12) United States Patent
Chen et al.

(10) Patent No.: US 8,845,341 B2
(45) Date of Patent: Sep. 30, 2014

(54) ELECTRICAL CONNECTOR ASSEMBLY

(71) Applicant: Bing Xu Precision Co. Ltd., Taipei (TW)

(72) Inventors: Chih-jung Chen, Taipei (TW); Wen-lung Lin, Taipei (TW)

(73) Assignee: Bing Xu Precision Co. Ltd., Taipei (TW)

( * ) Notice: Subject to any disclaimer, the term of this patent is extended or adjusted under 35 U.S.C. 154(b) by 129 days.

(21) Appl. No.: 13/739,526

(22) Filed: Jan. 11, 2013

(65) Prior Publication Data

US 2013/0217261 A1 Aug. 22, 2013

(30) Foreign Application Priority Data

Feb. 16, 2012 (TW) ..... 101202848 U

(51) Int. Cl.
*H01R 12/00* (2006.01)

(52) U.S. Cl.
USPC ..... 439/76.1; 439/493

(58) Field of Classification Search
USPC ..... 439/76.1, 492, 493
See application file for complete search history.

(56) References Cited

U.S. PATENT DOCUMENTS

| | | | | |
|---|---|---|---|---|
| 7,682,162 | B2 * | 3/2010 | Yuan | 439/76.1 |
| 7,708,587 | B2 * | 5/2010 | Wu | 439/492 |
| 7,803,009 | B2 * | 9/2010 | Su et al. | 439/492 |
| 7,815,459 | B2 * | 10/2010 | Chen et al. | 439/351 |

FOREIGN PATENT DOCUMENTS

| | | |
|---|---|---|
| CN | 201266719 | 7/2009 |
| TW | M348367 | 1/2009 |

* cited by examiner

*Primary Examiner* — Hien Vu
(74) *Attorney, Agent, or Firm* — Lowe Hauptman & Ham, LLP

(57) ABSTRACT

Disclosed is an electrical connector assembly which comprises an insulative body, a PCB and a base. The insulative body comprises a plurality of first terminals, and the base comprises a plurality of second terminals. The first terminals and the second terminals are electrically connected through the PCB; wherein the base is disposed with a movable member. When the movable member is in an open status, an FFC is inserted into the base. When the movable member is in a close state, the movable member presses against a plurality of conductors of the FFC to establish an electrical connection with the second terminals.

20 Claims, 11 Drawing Sheets

ELECTRICAL CONNECTOR ASSEMBLY

CROSS REFERENCE TO RELATED APPLICATION

This application claims the priority of Taiwanese Patent Application No. 101202848, filed on Feb. 16, 2012 in the TIPO (Taiwan Intellectual Property Office), the disclosure of which is incorporated herein in their entirety by reference.

BACKGROUND OF THE INVENTION

1. Field of the Invention

The present invention relates to an electrical connector assembly, and particularly relates to a Serial Advanced Technology Attachment (SATA) electrical connector assembly with a printed circuit board (PCB).

2. Description of Prior Art

Conventional technologies, such as the Taiwan patent No. M348367 "A cable connector assembly" (and its related foreign patents are CN patent publication No. CN201266719 and U.S. Pat. No. 7,815,459), the cable connector comprises an insulative body, a plurality of conductive terminals housed in the insulative body, a separative plate separating the conductive terminals, a support fixed on the insulative body, a cable electrically connecting the conductive terminals and a lid clapping on the insulative body. The base of the lid and the bottom of the insulative body are jointed. The jointed base and the lid are disposed on different sides of the bottom of the insulative body, and a housing space is defined, thereby the conductive terminals and the cable are electrically connected in the housing space.

However, the cable of the cable connector assembly in the conventional art cannot be replaced with a new cable in case the cable is worn out or defective and this results in scrapping the cable connector assembly all together. Therefore, it is desirable to propose an improvement to the cable connector assembly of the prior art.

SUMMARY OF THE INVENTION

Accordingly, the main objective of the present invention is to provide an electrical connector assembly, and the electrical connector assembly comprises an insulative body, a PCB and a base. The insulative body comprises a plurality of first terminals inserted into the insulative body, a plurality of second terminals are inserted into the base, and the first terminals and the second terminals are electrically connected through the PCB. A movable member is disposed on the base. When the movable member is in an open status, a flexible flat cable (FFC) is inserted into the base, and when the movable member is in an closed status, the movable member presses against the conductive parts of the FFFC to establish an electric connection with the second terminals.

One effect of the present invention is that an FFC is inserted into or removed from the electrical connector assembly whenever required, therefore, the electrical connector assembly is distributed with a hard disk or a CD-ROM together with an FFC inserted into the electric connector, or in case the hard disk or the CD-ROM is required to be replaced or maintained, the FFC is easily removed from the electrical connector assembly.

Another effect of the present invention is that in the case the FFC is worn out, the FFC is removed from the electrical connector assembly easily and be replaced with a new FFC to prevent the electrical connector assembly from being scrapped.

A first technical solution of the present invention is an electrical connector assembly which comprises:

an insulative body having a plurality of slots and a plurality of terminal slots;

a PCB having a plurality of welding holes and a plurality of conductive parts, which is fixed onto the insulative body, and each of the welding holes is electrically connected to each of the conductive parts respectively;

a plurality of first terminals inserted into the slots of the insulative body and the contacting parts of the first terminals extend into the terminal slots of the insulative body and each of the welding parts at the rear-end of the first terminals is respectively welded to each of the welding holes of the PCB;

a base having a rectangular hole and two guiding slots, and a plurality of second terminals are inserted into the base, the contacting parts of the second terminals are extended into the rectangular hole of the base, and each of the welding parts at the rear-end of the second terminals is respectively welded to each of the conductive parts of the PCB;

a movable member having a clamping surface and two clamping arms, and the clamping surface is inserted into the rectangular hole of the base, and the two clamping arms of the movable member are inserted into the two guiding slots of the base; and a FFC having an insulative layer which covers a plurality of conductors which is exposed at the front-end of the FFC; wherein the front-end of the FFC is inserted into the rectangular hole of the base, and the clamping surface of the movable member presses against the front-end of the FFC to enable the conductors of the FFC to contact with the contacting parts of the second terminals.

A second technical solution of the present invention is an electrical connector assembly which comprises:

an insulative body having a plurality of slots and a plurality of terminal slots;

a PCB having a plurality of welding holes and a plurality of conductive parts, which is fixed onto the insulative body, and each of the welding holes is respectively electrically connected to each of the conductive parts;

a plurality of first terminals inserted into the slots of the insulative body and the contacting parts of the first terminals extend into the terminal slots of the insulative body, also each of the welding parts at the rear-end of the first terminals is respectively welded to each of the welding holes of the PCB;

a base having a rectangular hole and two guiding slots, and a plurality of second terminals are inserted into the base, the contacting parts of the second terminals are extended into the rectangular hole of the base, and each of the welding parts at the rear-end of the second terminals is respectively welded to each of the conductive parts of the PCB; and a movable member having a clamping surface and two clamping arms, and the clamping surface is inserted into the rectangular hole of the base, and the two clamping arms of the movable member are inserted into the two guiding slots of the base; wherein two fixing terminals are inserted into the base, and each of the two fixing terminals of the base is welded to the PCB, a gap is defined by the clamping surface of the movable member and the contacting parts of the second terminals.

A third technical solution of the present invention is an electrical connector assembly which comprises:

an insulative body having a plurality of slots and a plurality of terminal slots;

a PCB having a plurality of welding holes and a plurality of conductive parts, which is fixed onto the insulative body, and each of the welding holes is respectively electrically connected to each of the conductive parts;

a plurality of first terminals inserted into the slots of the insulative body, and the contacting parts of the first terminals extend into the terminal slots of the insulative body, also each of the welding parts at the rear-end of the first terminals is respectively welded to each of the welding holes of the PCB; and a base having a rectangular hole, and a plurality of second terminals are inserted into the base, and the contacting parts of the second terminals extend into the rectangular hole of the base, and each of the welding parts at the rear-end of the second terminals is respectively welded to each of the conductive parts of the PCB; wherein the base comprises a movable member having a clamping surface, and the clamping surface is inserted into the rectangular hole of the base and define a gap by the clamping surface and the contacting parts of the second terminals.

DETAILED DESCRIPTION OF THE INVENTION

Figure 1:
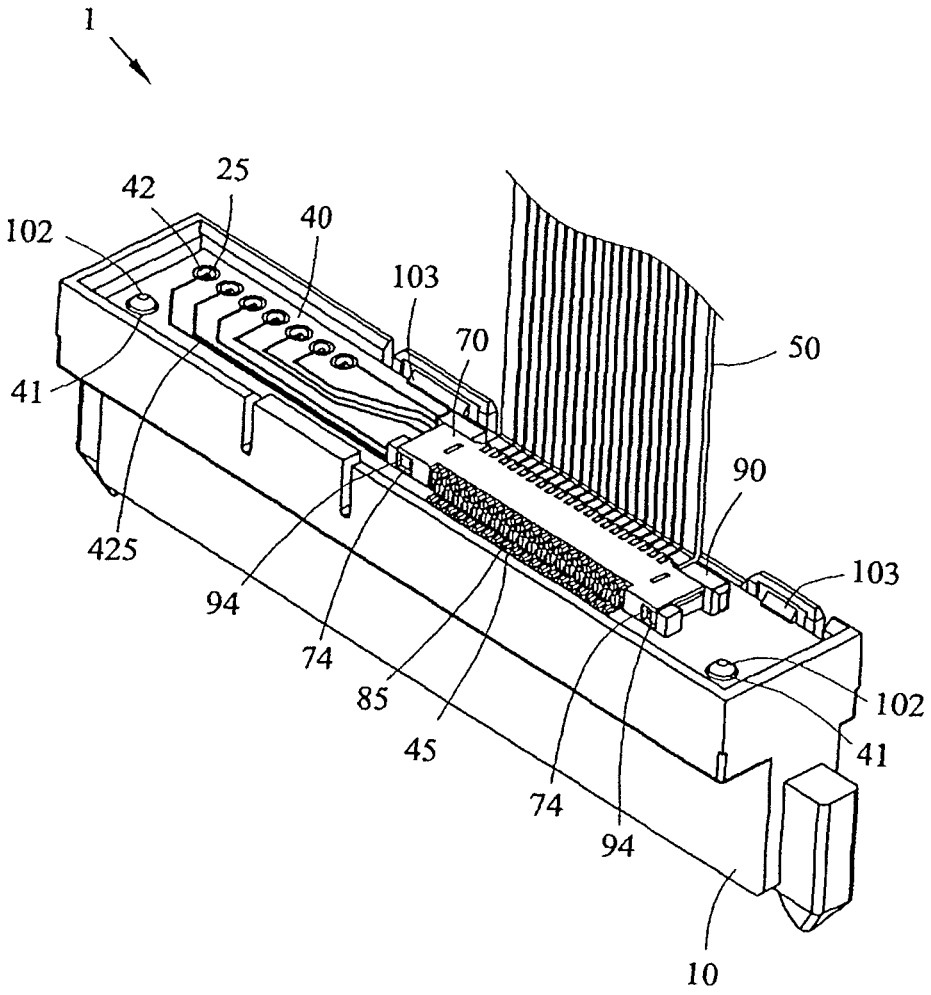
FIG. 1 is a dimensional diagram according to a preferred embodiment of the present invention.
Figure 2:
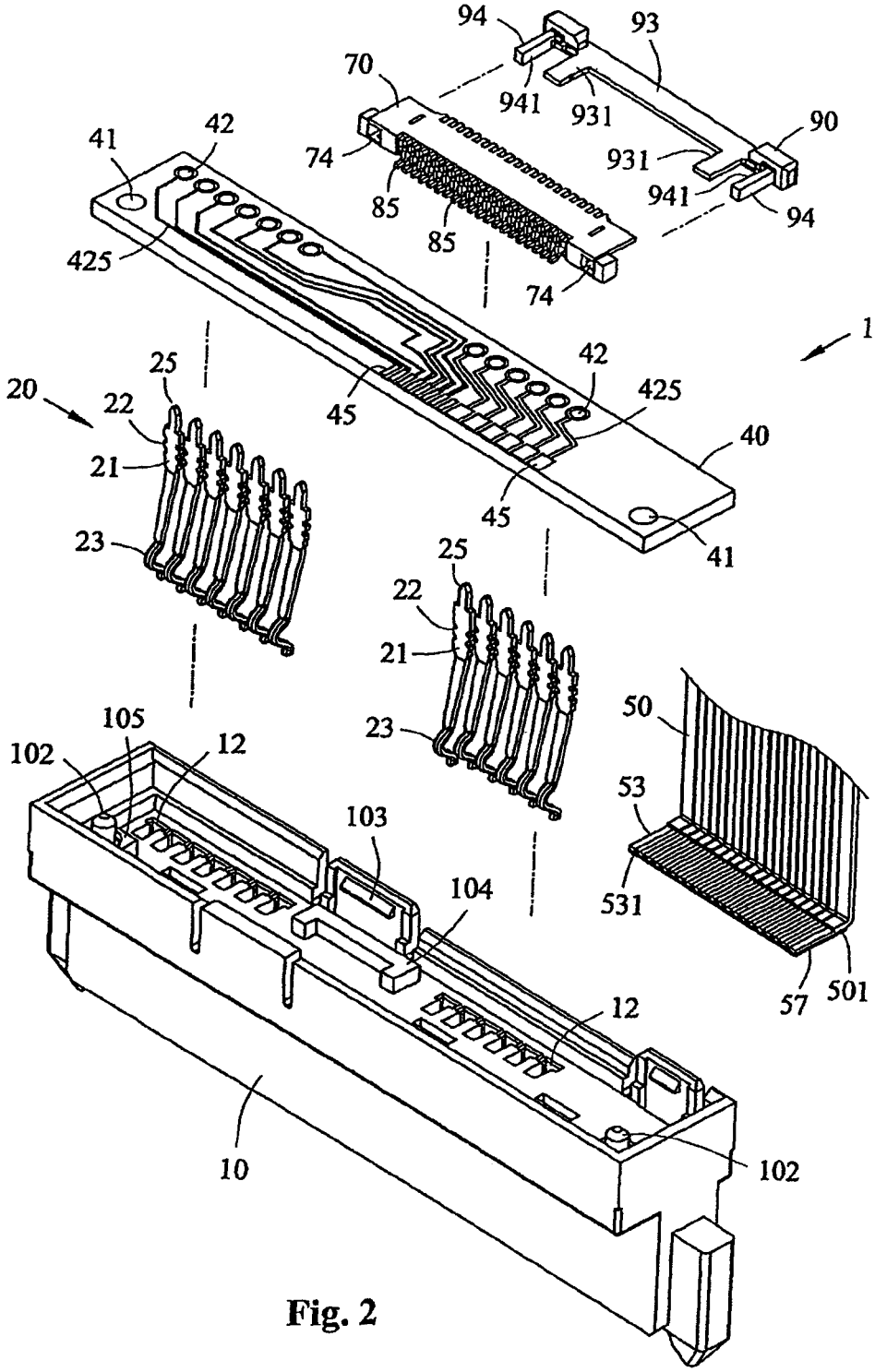
FIG. 2 is an exploded space diagram of a preferred embodiment according to the present invention.

To describe the technical matters, structural features, achieved objects and effects, the embodiments are described in detail with reference to the accompanying drawings as follows.

Please refer to FIGS. 1 to 5, in a preferred embodiment according to the present invention, the electrical connector assembly 1 comprises an insulative body 10, a plurality of first terminals 20, a printed circuit board 40, a FFC 50, a base 70, a plurality of second terminals 80 and a movable member 90. The insulative body 10 has a plurality of slots 12 and a plurality of terminal slots 123. The PCB 40 comprises a plurality of welding holes 42 and a plurality of conductive parts 45. The PCB 40 is fixed onto the insulative body 10, and each of the welding holes 42 and each of the plurality of wires 425 is respectively electrically connected to each of the conductive parts 45. A plurality of first terminals 20 is inserted into the slots 12 of the insulative body 10 (e.g. each fixing part 21 provided with a hook 22 to be fixed into the slots 12). The contacting parts 23 of the first terminals 20 are extended into the terminal slots 123 of the insulative body 10. Each of the welding parts 25 which is at the rear-end of the first terminals 20 is welded to each of the welding holes 42 of the PCB 40. The base 70 is provided with a rectangular hole 73 and two guiding slots 74. The base 70 is embedded with a plurality of second terminals 80. The contacting parts 83 of the second terminals 80 are extended into the rectangular holes 73 of the base 70. Each of the welding parts 85 of the second terminals 80 is respectively welded to each of the conductive parts 45 of the PCB 40. The movable member 90 is provided with a clamping surface 93 and two clamping arms 94. The clamping surface 93 is inserted into the rectangular holes 73 of the base 70, and the two clamping arms 94 of the movable member 90 are inserted into the two guiding slots 74 of the base 70. The movable member 90 clamps to the base 70 via the two clamping arms 94 and is operable to be moved to an open status or a closed status. The FFC 50 has an insulative layer 501 which covers a plurality of conductors 531. The plurality of conductors 531 is uncovered at the front-end 53 of the FFC 50. The front-end 53 of the FFC 50 is inserted into the rectangular holes 73 of the base 70 and the movable member 90, such that the clamping surface 93 presses against the front-end 53 of the FFC 50. Thus, the conductors 531 of the FFC 50 is in contact with the contacting parts 83 of the second terminals 80, whereby, the electrical connector assembly 1 is suitable to install or remove an FFC 50 whenever required. For example, an FFC 50 is installed to be distributed together with a hard disk or a CD-ROM (Not Shown) in case the hard disk or the CD-ROM needs to be reinserted or maintained. The FFC 50 of the electrical connector assembly 1 can be removed easily. Additionally, in case the FFC 50 is worn out, the FFC 50 of the electrical connector assembly 1 is removed as well, so that a new FFC 50 can be easily installed.

Figure 3:
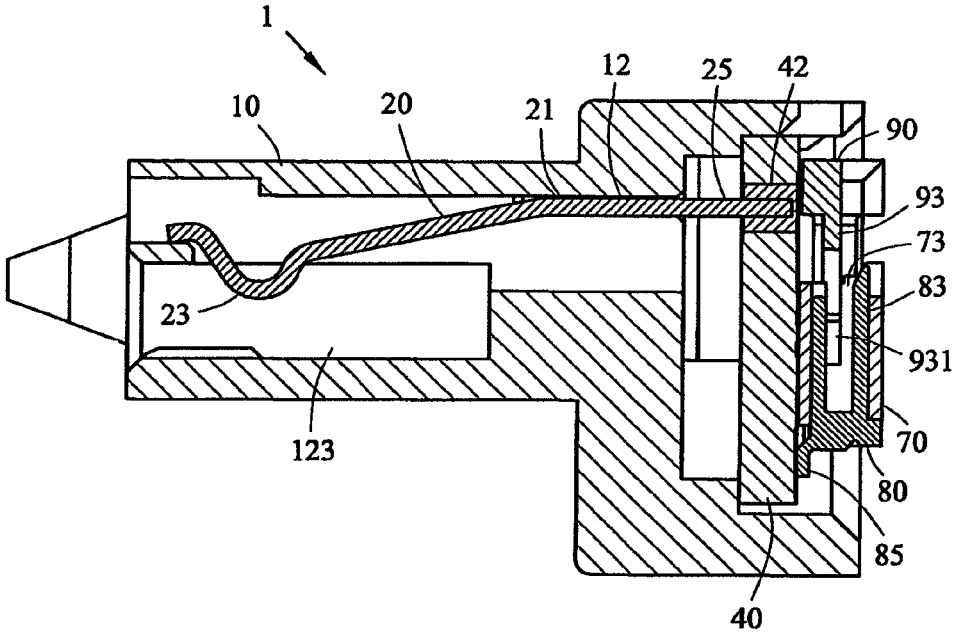
FIG. 3 is a schematic diagram of the movable member in an open status in a preferred embodiment according to the present invention.
Figure 4:
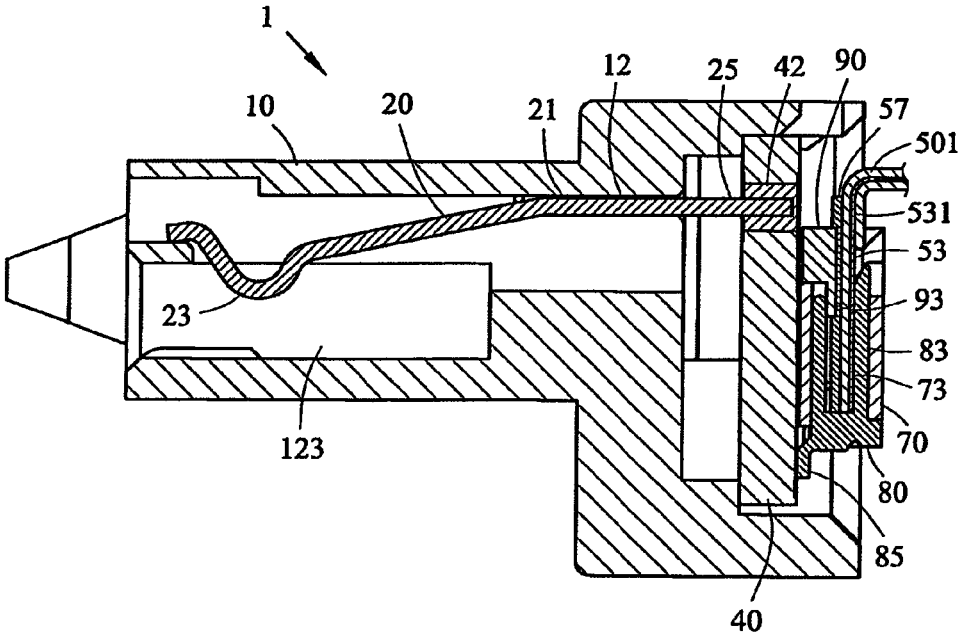
FIG. 4 is a schematic diagram of placing a FFC in a preferred embodiment according to the present invention.
Figure 5:
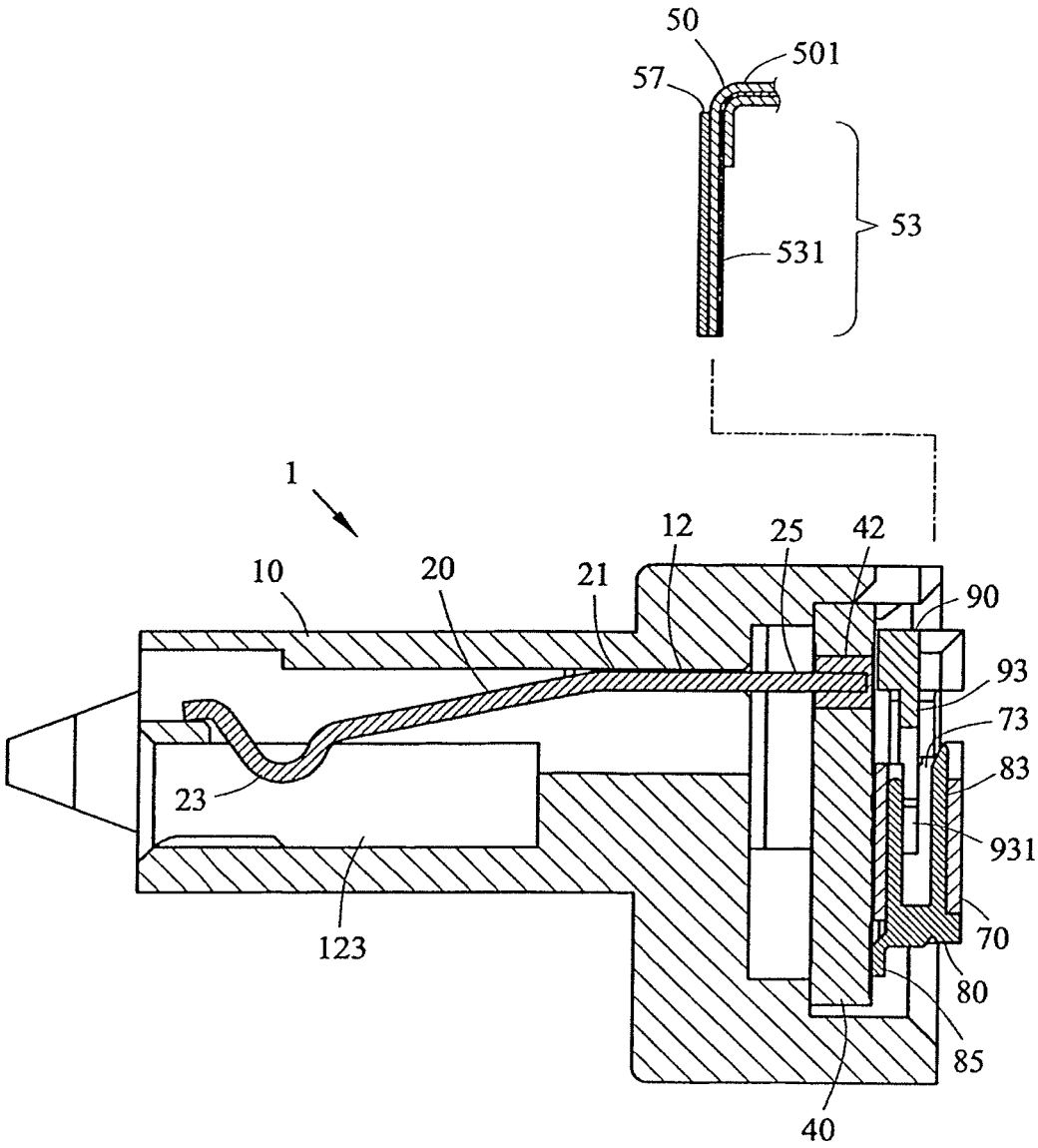
FIG. 5 is a schematic diagram of removing a FFC in a preferred embodiment according to the present invention.
Figure 6:
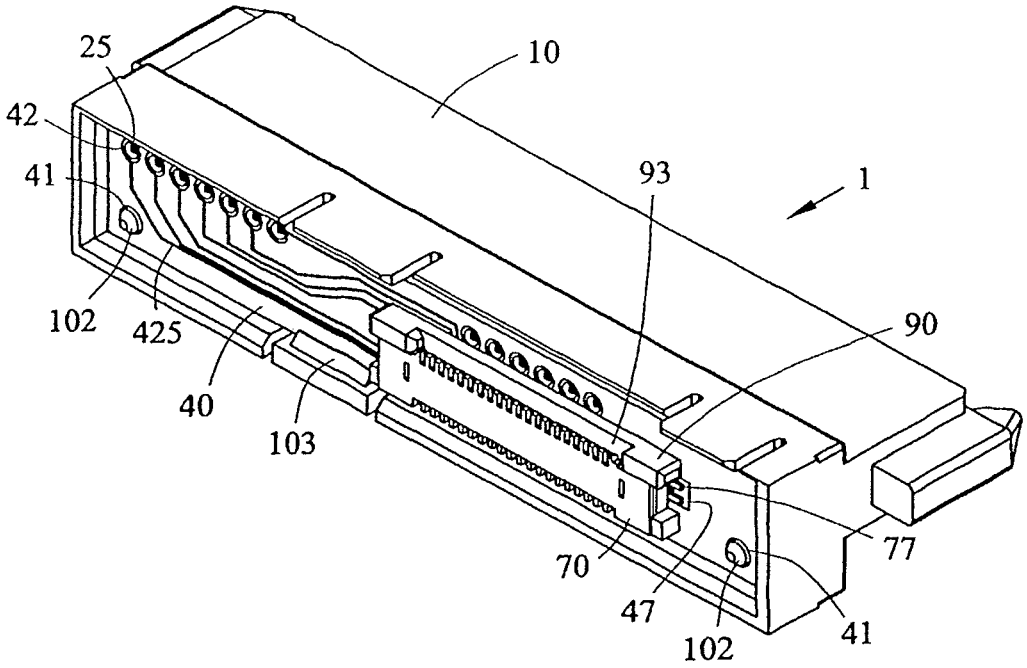
FIG. 6 is a space diagram of a second embodiment according to the present invention.
Figure 7:
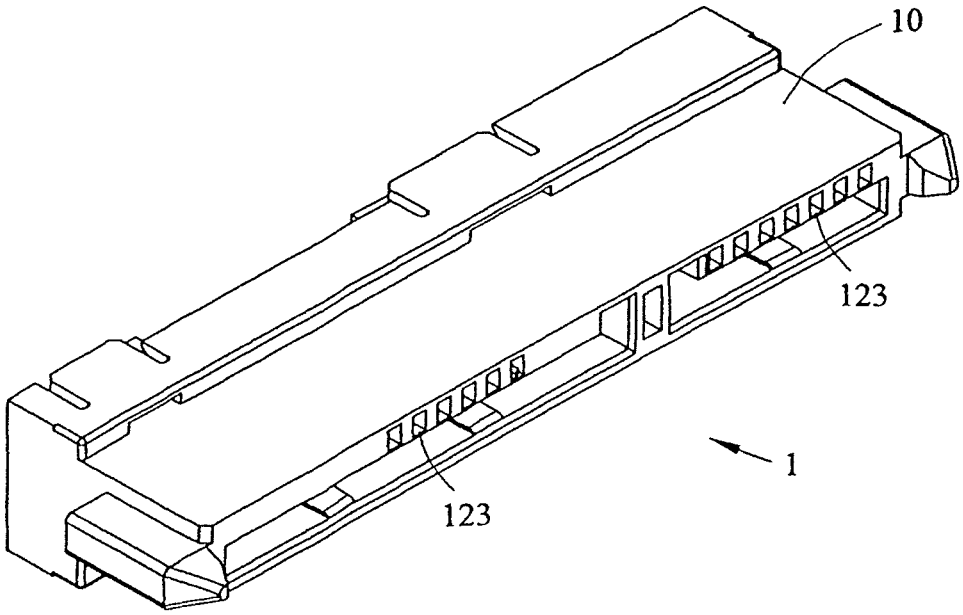
FIG. 7 is another space diagram of the second embodiment according to the present invention, which is from a different angle.
Figure 8:
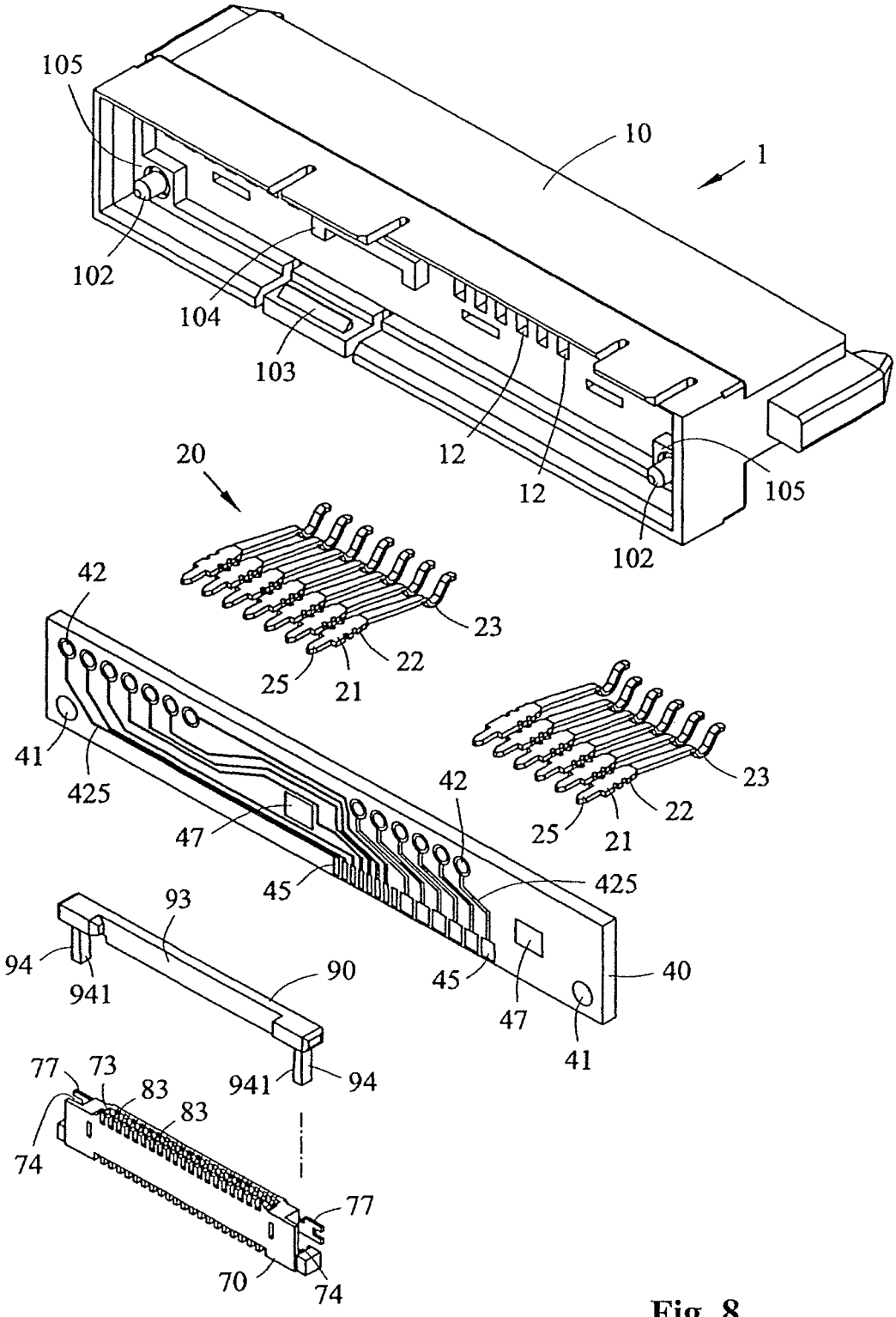
FIG. 8 is an exploded space diagram of the second embodiment according to the present invention.
Figure 9:
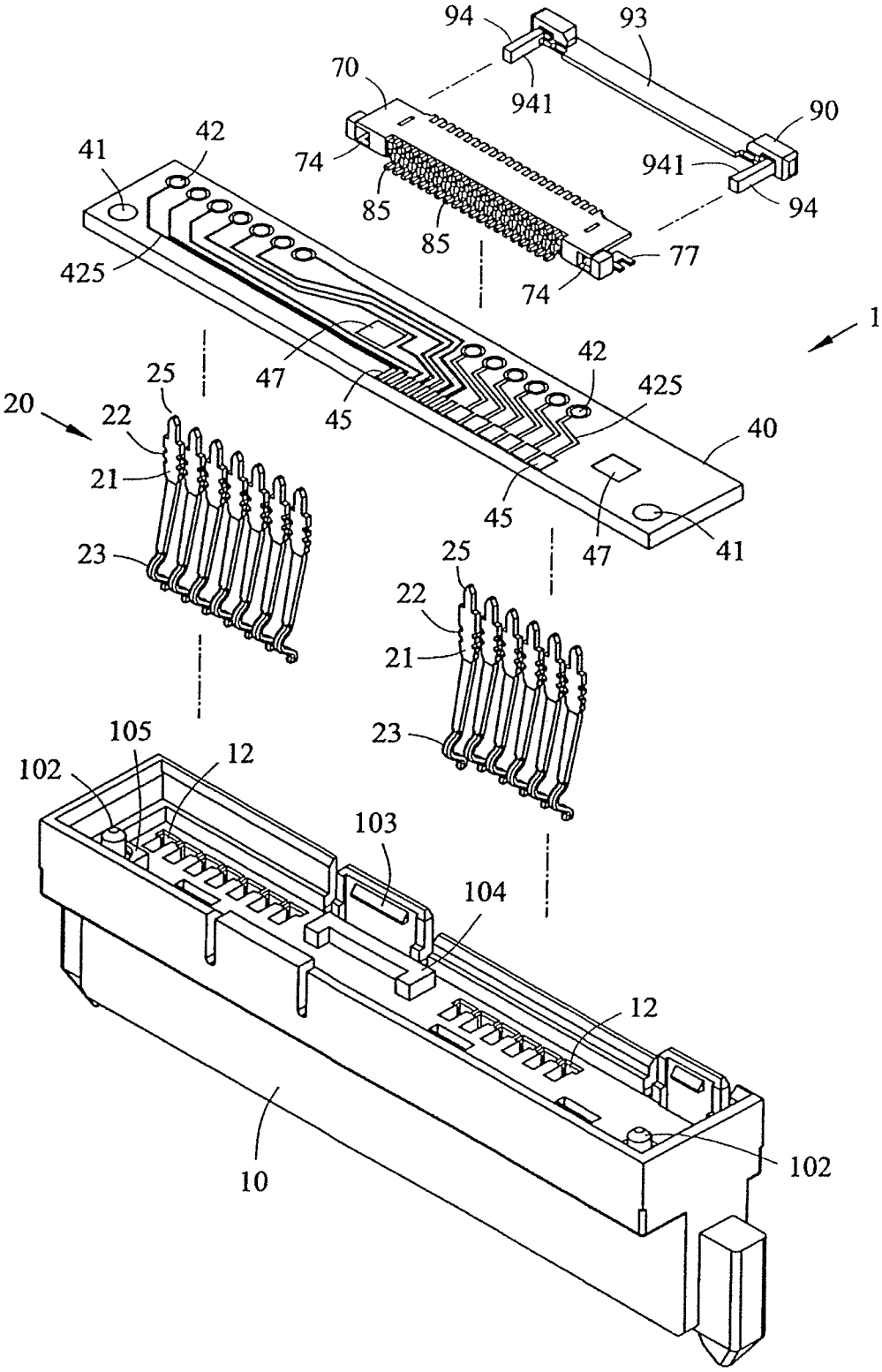
FIG. 9 is another exploded space diagram of the second embodiment according to the present invention, which is from a different angle.

The movement of the movable member 90 is as follows. When the movable member 90 is moved to an open status, and the clamping surface 93 of the movable member 90 is detached from the rectangular hole 73 of the base 70 (As illustrated in FIG. 3). Then, the front-end 53 of the FFC 50 is inserted into the rectangular hole 73 of the base 70, and the movable member 90 can be moved to a closed state. Now, the clamping surface 93 of the movable member 90 presses against the front-end 53 of the FFC 50 to enable the conductors 531 of the FFC 50 to contact with the contacting parts 83 of the second terminals 80 (As illustrated in FIG. 4). Furthermore, as the movable member 90 is moved to an open status again, and the clamping surface 93 of the movable member 90 is disjoined from the front-end 53 of the FFC 50 (As illustrated in FIG. 5), and then the front-end 53 of the FFC 50 can be removed out of the rectangular hole 73 of the base 70.

In order to increase the clamping force from the movable member 90 to the base 70, each of the two clamping arms of the movable member 90 is provided further with a rake face 941. When the two clamping arms 94 of the movable member 90 are inserted into the two guiding slots 74 of the base 70, the two clamping arms 94 clamp the base 70 via the rake faces 941 to acquire an improved clamping force.

In order to increase the clamping force from the movable member 90 to the FFC 50, the clamping surface 93 of the moving part 90 further comprises two extension pieces 931. When the two extension pieces 931 are inserted into the rectangular hole 73 of the base 70, the movable member 90 presses against the front-end 53 of the FFC 50 through the two extension pieces 931 to acquire an improved clamping force.

In order to improve the firmness between the PCB 40 and the insulative body 10, the insulative body 10 is disposed with at least one positioning rod 102 and engaging part 103. The PCB 40 is disposed with at least one fixing hole 41. When the PCB 40 is joined with the insulative body 10, the PCB 40 is fixed to the corresponding positioning rod 102 at the fixing hole 41 and the engaging part 103 engages the PCB 40 to the insulative body 10.

In order to secure the position of the PCB 40, the positioning rods 102 of the insulative body 10 are disposed with at least one stopper part 105, and a stopper block 104 is further disposed on the insulative body 10. Therefore, the PCB 40 can be jointly engaged by the engaging part 103 and the stopper block 104 and the PCB 40 is engaged by the stopper part 105 of the insulative body 10.

In order to protect the front-end 53 of the FFC 50, the front-end 53 of the FFC 50 is further disposed with a protective film 57 which is attached to the insulative layer 501 of the FFC 50.

Please refer to FIGS. 6 to 11, in a second embodiment, the electrical connector assembly 1 according to the present invention comprises an insulative body 10, a plurality of first terminals 20, a PCB 40, a base 70, a plurality of second terminals 80 and a movable member 90. The insulative body 10 has a plurality of slots 12 and a plurality of terminal aperture 123. The PCB 40 has a plurality of welding holes 42 and a plurality of conductive parts 45. The PCB 40 is fixed to the insulative body 10. Each of the welding holes 42 and each of the plurality of wires 425 is respectively electrically connected to each of the conductive parts 45. A plurality of first terminals 20 is inserted into the slots 12 of the insulative body 10 (e.g. each fixing part 21 provided with a hook 22 to be fixed into the slots 12). The contacting parts 23 of the first terminals 20 are extended into the terminal slots 123 of the insulative body 10. Each of the welding parts 25 at the rear-end of the first terminals 20 is welded to each of the welding holes 42 of the PCB 40. The base 70 is provided with a rectangular hole 73 and two guiding slots 74. The base 70 is embedded with a plurality of second terminals 80, and the contacting parts 83 of the second terminals 80 are extended into the rectangular hole 73 of the base 70. Each of the welding parts 85 of the second terminals 80 is respectively welded to each of the conductive parts 45 of the PCB 40. The movable member 90 has a clamping surface 93 and two clamping arms 94. The clamping surface 93 is inserted into the rectangular holes 73 of the base 70. The two clamping arms 94 of the movable member 90 are inserted into the two guiding slots 74 of the base 70. The movable member 90 clamps the base 70 via the two clamping arms 94 and is operable to be moved back and forth. The base 70 is disposed with two fixing terminals 77 each of which is welded to each of the two welding parts 47 of the PCB 40 to improve the firmness between the base 70 and the PCB 40. A gap 731 is defined by the clamping surface 93 of the movable member 90 and the contacting parts 83 of the second terminals 80, whereby a flexible print circuit (FPC, not shown) or a FFC (not shown) can be inserted into the gap. The clamping surface 93 of the movable member 90 presses against the FPC or the FFC, so as to establish an electric connection between the contacting parts 83 of the second terminal 80 and the FPC or the FFC.

Figure 10:
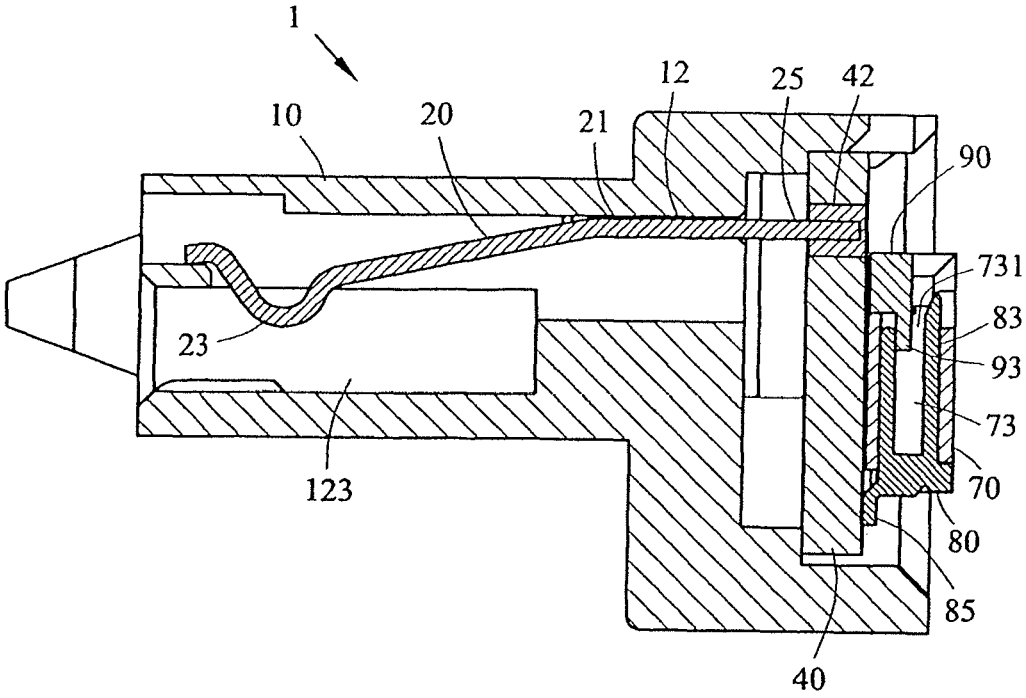
FIG. 10 is a schematic diagram of a movable member at a closed state in the second embodiment according to the present invention.
Figure 11:
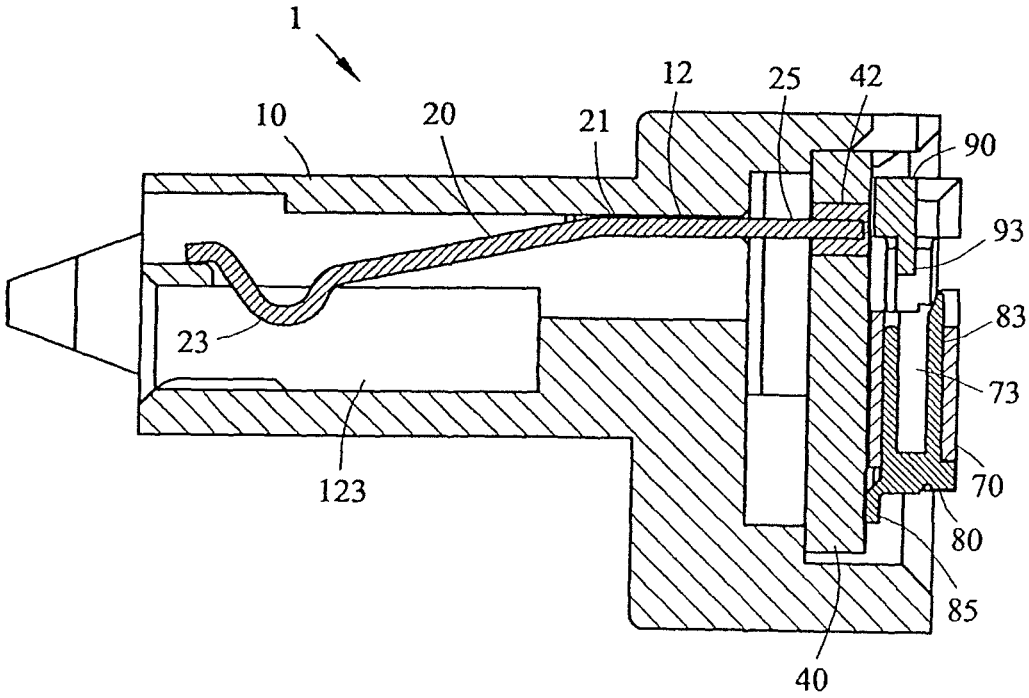
FIG. 11 is a schematic diagram of a movable member in an open status in the second embodiment according to the present invention.
Figure 12:
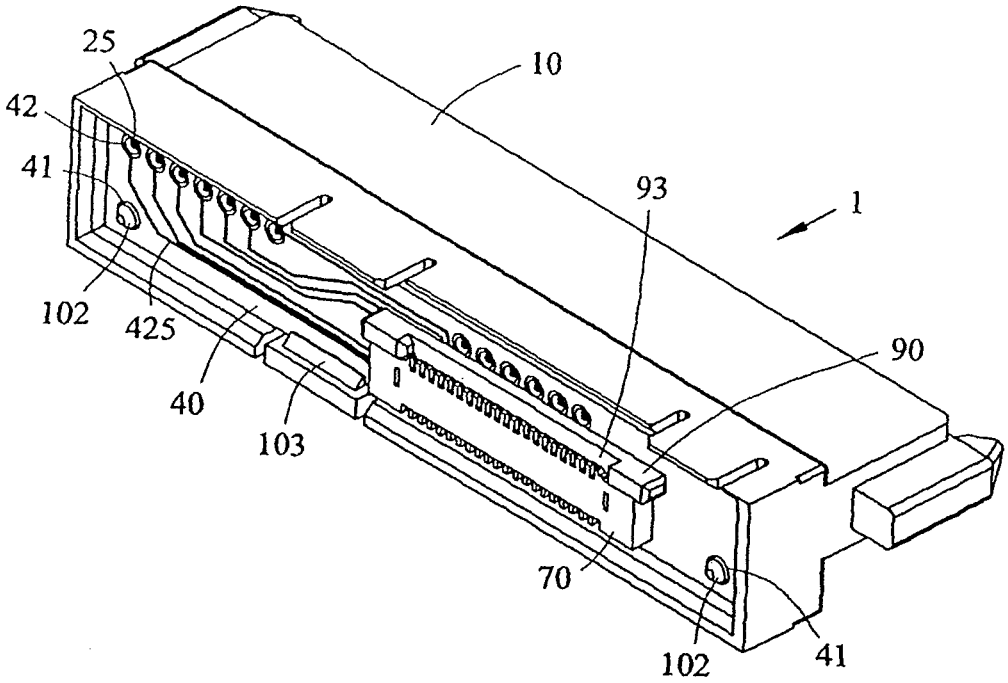
FIG. 12 is a space diagram of a third embodiment according to the present invention.
Figure 13:
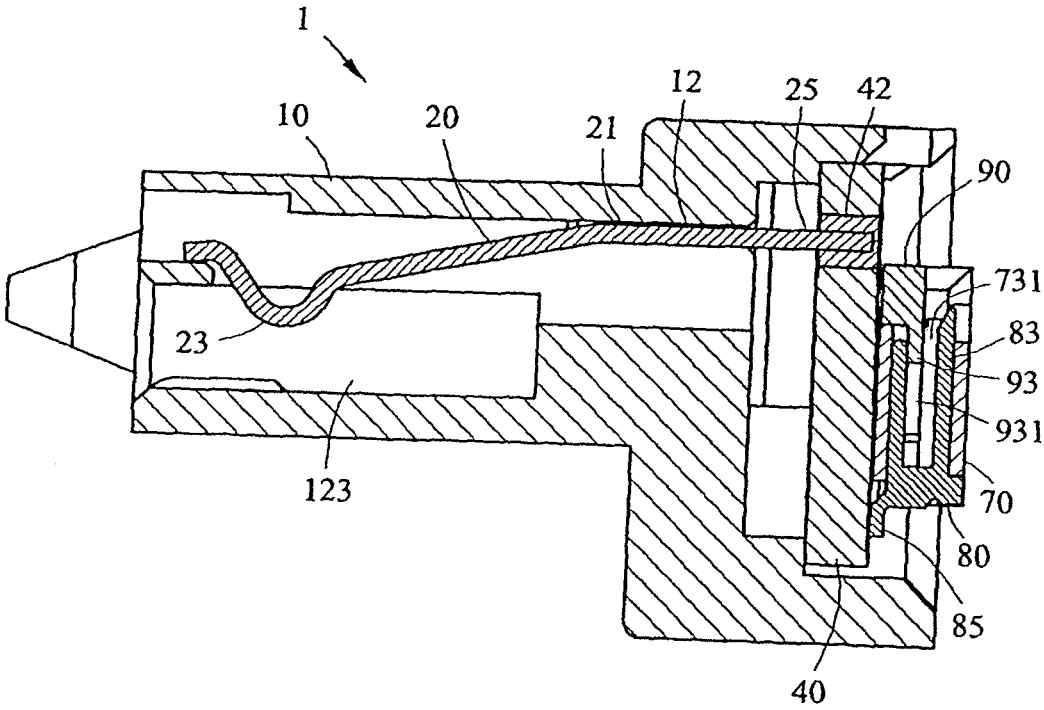
FIG. 13 is a schematic diagram of a movable member in a closed state in the third embodiment according to the present invention.
Figure 14:
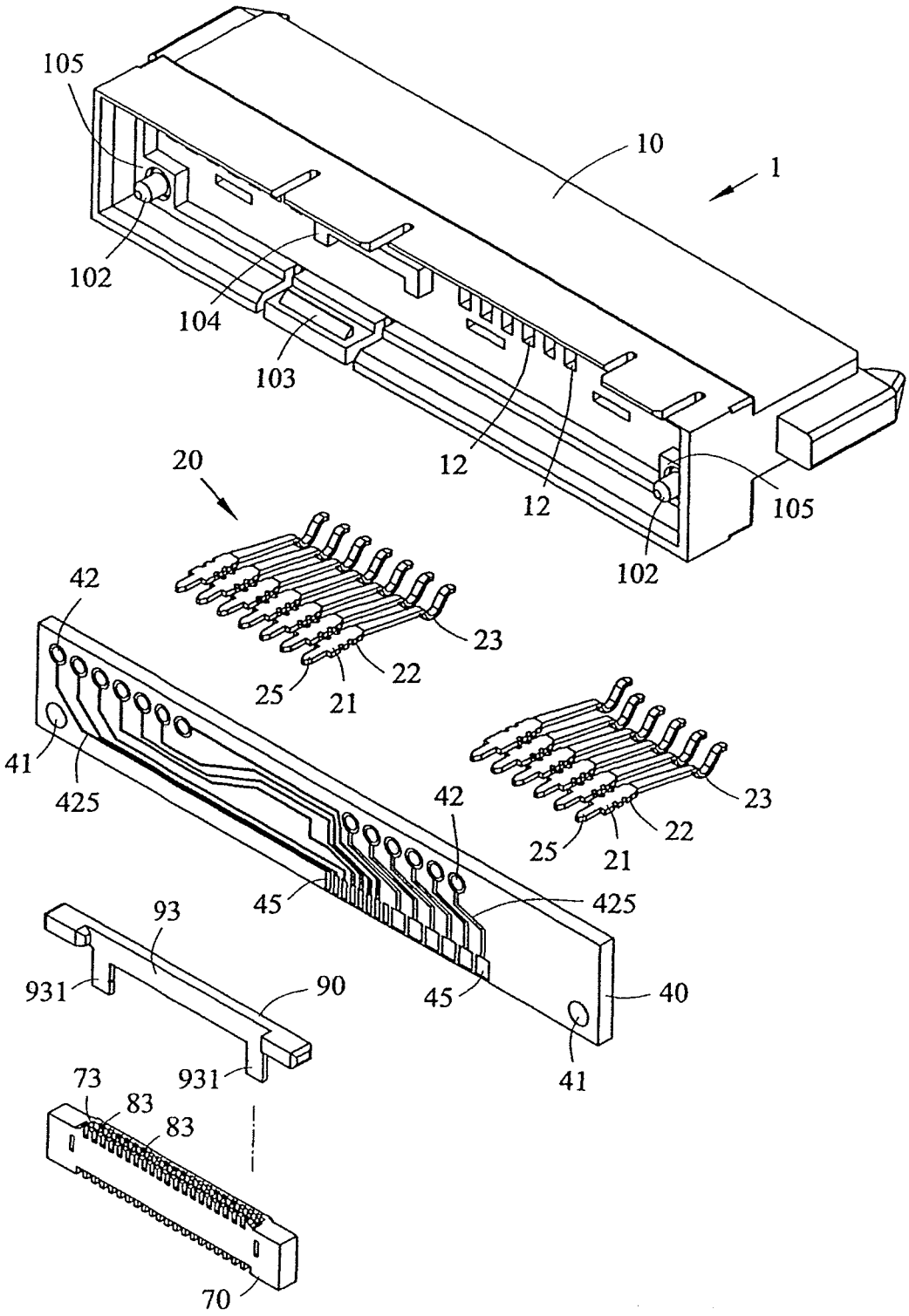
FIG. 14 is an exploded space diagram of the third embodiment according to the present invention.
Figure 15:
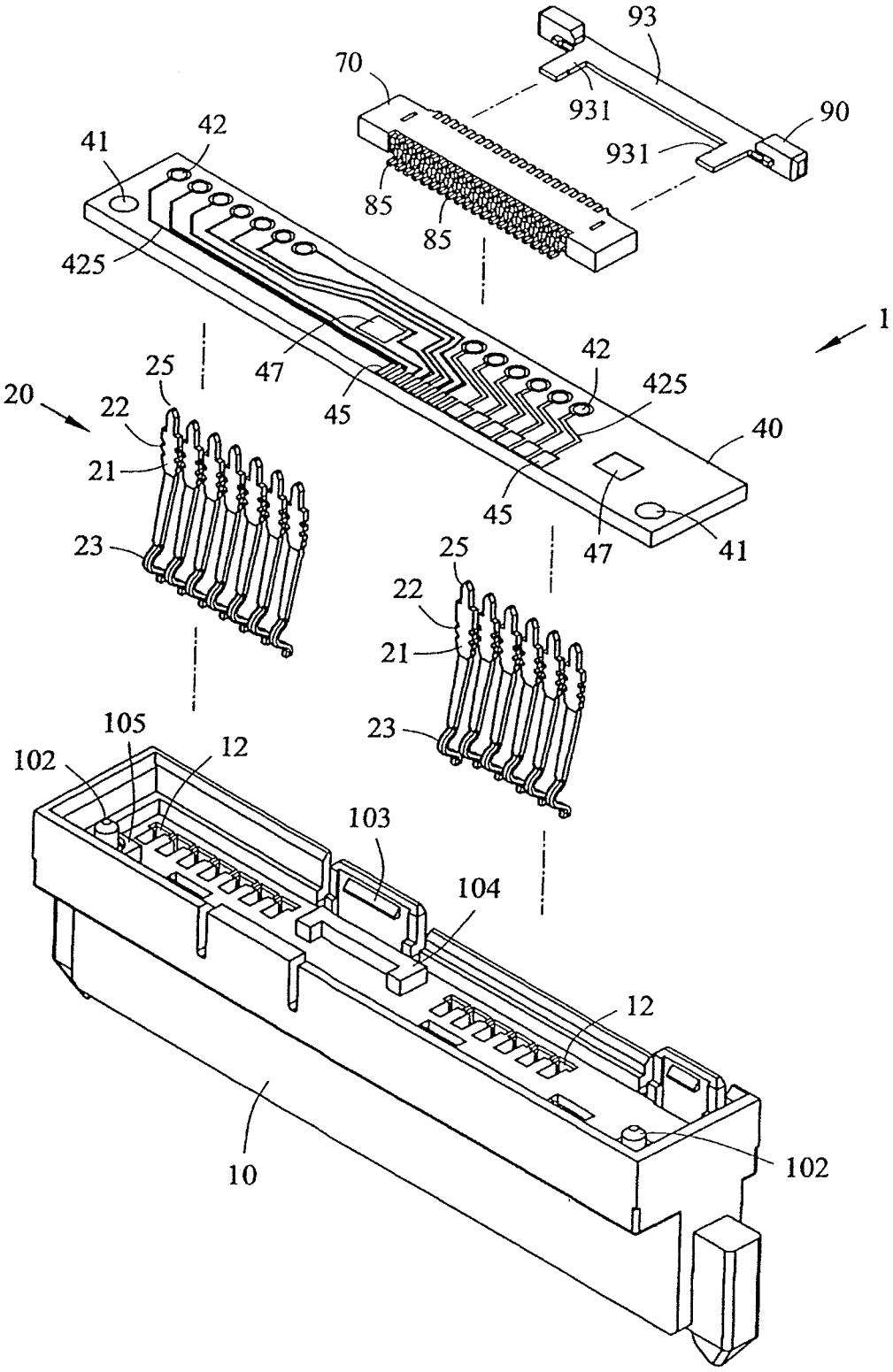
FIG. 15 is another exploded space diagram of the third embodiment according to the present invention, which is from a different angle.

The defining of the gap 731 is described as follows: when the movable member 90 is moved to a closed state, and the clamping surface 93 of the movable member 90 is inserted through the rectangular hole 73 of the base 70, and the gap 731 is defined by the clamping surface 93 of the movable member 90 and the contacting parts 83 of the second terminal 80 (as shown in FIG. 10). Besides, when the movable member 90 is moved to an open status, the clamping surface 93 of the movable member 90 is disjoined from the rectangular hole 73 of the base 70 (as shown in FIG. 11).

The construction of the PCB 40 is as follows: each of the conductive parts 45 of the PCB 40 is electrically connected to each of the welding holes 42 in an one to one manner (every single conductive part 45 is electrically connected to a single welding hole 42 through a wire 425). Alternatively, each of the conducting parts 45 of the PCB 40 is electrically connected to each of the welding holes 42 in a many to one manner (each of the several conductive parts 45 is electrically connected to a welding hole 42 through several wires 425).

Please refer to FIGS. 12 to 15, in a third embodiment, the electrical connector assembly 1 according to the present invention comprises an insulative body 10, a plurality of first terminals 20, a PCB 40, a base 70, a plurality of second terminals 80 and a movable member 90 and etc. The insulative body 10 has a plurality of slots 12 and a plurality of terminal slots 123. The PCB 40 has a plurality of welding holes 42 and a plurality of conductive parts 45. The PCB 40 is fixed to the insulative body 10, and each of the welding holes 42 and the plurality of wires 425 is respectively electrically connected to each of the conductive parts 45. A plurality of first terminals 20 is inserted into the slots 12 of the insulative body 10 (e.g. a fixing parts 21 provided with a hook 22 to be fixed into the slots 12. The contacting parts 23 of the first terminals 20 are extended into the terminal slots 123 of the insulative body 10, and each of the welding parts 25 at the rear-end of the first terminals 20 is welded to each of the welding holes 42 of the PCB 40. The base 70 has a rectangular hole 73 and two guiding slots 74. The base 70 is embedded with a plurality of second terminals 80. The contacting parts 83 of the second terminals 80 are extended into the rectangular holes 73 of the base 70, and each of the welding parts 85 of the second terminals 80 is respectively welded to each of the conductive parts 45 of the PCB 40. A movable member 90 is disposed on the base 70. The movable member 90 has a clamping surface 93 that is inserted into the rectangular hole 73 of the base. A gap 731 is defined by the clamping surface 93 of the movable member 90 and the contacting parts 83 of the second terminals 80, whereby a Flexible Printed Circuit (not shown) or a FFC (not shown) is inserted into the gap. The clamping surface 93 of the movable member 90 presses against the Flexible Printed Circuit or FFC, so as to facilitate an electric connection between the contacting parts 83 of the terminals 80 and the Flexible Printed Circuit or the FFC.

In order to reduce the gap 731, and the clamping surface 93 of the movable member 90 is further provided with two extension pieces 931. When the two extension pieces 931 of the movable member 90 are inserted into the rectangular hole 73 of the base 70. Thereby, the gap 731 defined by the clamping surface 93 and the contacting parts 83 of the second terminals 80 can be reduced.

All in all, this application is proposed as the aspects of the present invention are indeed attained, therefore, please grant the patent at an early date so that the purpose of the Patent Law, which is to encourage creativity, could be served. It should be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

an insulative body having a plurality of slots and a plurality of terminal slots;

a printed circuit board (PCB) having a plurality of welding holes and a plurality of conductive parts, the PCB being fixed onto the insulative body, and each of the welding holes being respectively electrically connected to each of the conductive parts;

a plurality of first terminals inserting into the slots of the insulative body, the first terminals having contacting parts extending into the terminal slots of the insulative body, and each of the welding parts at the rear-end of the first terminals being respectively welded to each of the welding holes of the PCB;

a base having a rectangular hole and two guiding slots, the base having a plurality of second terminals being inserted therein, wherein the contacting parts of the second terminals are extended into the rectangular hole of the base, and each of the welding parts at the rear-end of the second terminals is respectively welded to each of the conductive parts of the PCB;

a movable member having a clamping surface and two clamping arms, the clamping surface passing through the rectangular hole of the base, and the two clamping arms of the movable member passing through the two guiding slots of the base; and a flexible flat cable (FFC) having an insulative layer, the insulative layer being disposed with a plurality of conductors, the plurality of conductors being exposed at the front-end of the FFC; wherein the front-end of the FFC is inserted into the rectangular hole of the base, and the clamping surface of the movable member presses against the front-end of the FFC to enable the conductors of the FFC to contact with the contacting parts of the second terminals.

2. The electrical connector assembly as claimed in claim 1, wherein each of the two clamping arms of the movable member has a rake face to clamp the base.

3. The electrical connector assembly as claimed in claim 1, wherein the clamping surface of the movable member comprises two extension pieces, and the two extension pieces are inserted into the rectangular hole of the base and press against the front-end of the FFC.

4. The electrical connector assembly as claimed in claim 1, wherein the insulative body comprises at least one positioning rod and engaging part, and the PCB comprises at least one fixing hole to be fixed to the positioning rod of the insulative body, thus the engaging part of the insulative body is engaged to the PCB.

5. The electrical connector assembly as claimed in claim 4, wherein the positioning rod of the insulative body comprises at least one stopper part and the insulative body further comprises a block, whereby the PCB is engaged by the engaging part, the stopper part and the block of the insulative body.

6. The electrical connector assembly as claimed in claim 1, wherein the FFC is disposed with a protective film which is bonded onto the insulative layer of the FFC.

7. An electrical connector assembly comprising:

an insulative body having a plurality of slots and a plurality of terminal slots;

a printed circuit board (PCB), having a plurality of welding holes and a plurality of conductive parts, the PCB being fixed onto the insulative body, and each of the welding holes being respectively electrically connected to each of the conductive parts;

a plurality of first terminals inserting into the slots of the insulative body, the first terminals having contacting parts extending into the terminal slots of the insulative body, and each of the welding parts at the rear-end of the first terminals being respectively welded to each of the welding holes of the PCB;

a base having a rectangular hole and two guiding slots, the base having a plurality of second terminals inserted therein, wherein the contacting parts of the second terminals are extended into the rectangular hole of the base, and each of the welding parts at the rear-end of the second terminals is respectively welded to each of the conductive parts of the PCB; and a movable member having a clamping surface and two clamping arms, and the clamping surface being inserted into the rectangular hole of the base, and each of the two clamping arms of the movable member being inserted into the two guiding slots of the base; wherein two fixing terminals are inserted into the base, and each of the two fixing terminals of the base is welded to the PCB, a gap is defined by the clamping surface of the movable member and the contacting parts of the second terminals.

8. The electrical connector assembly as claimed in claim 7, wherein the clamping surface of the movable member comprises two extension pieces, and the two extension pieces pass through the rectangular hole of the base.

9. The electrical connector assembly as claimed in claim 7, wherein a flexible printed circuit (FPC) is inserted into the gap, and the clamping surface of the movable member presses against the FPC to enable the contacting parts of the second terminals to electrically connect to the Flexible Printed Circuit.

10. The electrical connector assembly as claimed in claim 7, wherein a FFC is inserted into the gap, and the clamping surface of the movable member presses against the FFC, thus the contacting parts of the second terminals are electrically connected to the FFC.

11. The electrical connector assembly as claimed in claim 7, wherein each of the conductive parts of the PCB is electrically connected to each of the welding holes in a many-to-one manner.

12. The electrical connector assembly as claimed in claim 7, wherein each of the conductive parts of the PCB is electrically connected to each of the welding holes in a one-to-one manner.

13. The electrical connector assembly as claimed in claim 7, wherein the insulative body comprises at least one positioning rod and engaging part, and the PCB comprises at least one fixing hole to be fixed on the positioning rod of the insulative body, and the engaging part of the insulative body is engaged to the PCB.

14. The electrical connector assembly as claimed in claim 13, wherein the positioning rod of the insulative body comprises at least one stopper part and the insulative body further comprises a block, whereby the PCB is engaged by the engaging part, the stopper part and the block of the insulative body.

15. An electrical connector assembly comprising:

an insulative body, having a plurality of slots and a plurality of terminal slots;

a printed circuit board (PCB), having a plurality of welding holes and a plurality of conductive parts, the PCB being fixed onto the insulative body, and each of the welding holes being respectively electrically connected to each of the conductive parts;

a plurality of first terminals, inserting into the slots of the insulative body, the first terminals having contacting parts extending into the terminal slots of the insulative body, and each of the welding parts at the rear-end of the first terminals being respectively welded to each of the welding holes of the PCB; and a base, having a rectangular hole, and a plurality of second terminals being inserted into the base, the contacting parts of the second terminals being extended into the rectangular hole of the base, and each of the welding parts at the rear-end of the second terminals being respectively welded to each of the conductive parts of the PCB; wherein the base comprises a movable member having a clamping surface, and the clamping surface is inserted into the rectangular hole of the base, and define a gap by the clamping surface and the contacting parts of the second terminals.

16. The electrical connector assembly as claimed in claim 15, wherein the clamping surface of the movable member comprises two extension pieces, and the two extension pieces are inserted into the rectangular hole of the base.

17. The electrical connector assembly as claimed in claim 15, wherein each of the conductive parts of the PCB is electrically connected to each of the welding holes in a many to one manner.

18. The electrical connector assembly as claimed in claim 15, wherein each of the conductive parts of the PCB is electrically connected to each of the welding holes in a one to one manner.

19. The electrical connector assembly as claimed in claim 15, wherein the insulative body comprises at least one positioning rod and engaging part, and the PCB comprises at least one fixing hole to be fixed to the positioning rod of the insulative body, and the engaging part of the insulative body clamps the PCB.

20. The electrical connector assembly as claimed in claim 19, wherein the positioning rod of the insulative body comprises at least one stopper part and the insulative body further comprises a block, whereby the PCB is engaged by the engaging part, the stopper part and the block of the insulative body.

* * * * *